US005446943A

United States Patent [19]

Sovis et al.

[11] Patent Number: 5,446,943

[45] Date of Patent: Sep. 5, 1995

[54] COMPACT AIR PATH CONSTRUCTION FOR VACUUM CLEANER

[75] Inventors: John F. Sovis, Twinsburg; Paul D. Stephens, Cleveland Heights; Michael F. Wright, Cuyahoga Falls; Mark E. Cipolla, Chardon, all of Ohio

[73] Assignee: Royal Appliance Mfg. Co., Cleveland, Ohio

[21] Appl. No.: 1,443

[22] Filed: Jan. 7, 1993

[51] Int. Cl.[6] ..... A47L 5/28

[52] U.S. Cl. ..... 15/350; 15/412; 415/206

[58] Field of Search ..... 415/206; 15/350, 351, 15/412

[56] References Cited

U.S. PATENT DOCUMENTS

| | | | |
|---|---|---|---|
| Re. 32,751 | 9/1988 | Joss et al. . | |
| 2,019,895 | 11/1935 | Dow | 15/350 X |
| 2,187,164 | 1/1940 | Leathers | 15/350 X |
| 2,346,339 | 4/1944 | Vose . | |
| 2,420,401 | 5/1947 | Prokofieff | 415/206 X |
| 2,540,178 | 2/1951 | Smith | 415/206 X |
| 2,626,418 | 1/1953 | Kelly et al. . | |
| 3,055,039 | 9/1962 | Smith | 15/350 X |
| 3,188,681 | 6/1965 | Jepson et al. | 15/351 X |
| 3,189,933 | 6/1965 | Smith . | |
| 3,190,226 | 6/1965 | Judd | 415/206 X |
| 3,273,194 | 9/1966 | Jepson et al. | 15/350 X |
| 3,321,794 | 5/1967 | Jepson et al. . | |
| 3,715,775 | 2/1973 | Nickelson | 15/351 X |
| 4,082,478 | 4/1978 | Schmitz | 415/206 X |
| 4,171,553 | 10/1979 | Stein . | |
| 4,302,225 | 11/1981 | Eckart et al. . | |
| 4,376,322 | 3/1983 | Lockhart et al. . | |
| 5,107,567 | 4/1992 | Ferrari et al. | 15/350 |
| 5,137,424 | 8/1992 | Daniel | 415/206 |
| 5,277,232 | 1/1994 | Borsheim | 415/206 X |

*Primary Examiner*—Christopher K. Moore

*Attorney, Agent, or Firm*—Fay, Sharpe, Beall, Fagan, Minnich & McKee

[57] ABSTRACT

An air path for a vacuum cleaner, such as a stick type or broom type vacuum cleaner includes a first fan shell section having a first end at which is located a suction opening and a second end. A second fan shell section has a first end and a second end at which is located an outlet opening. An air outlet tube is located at the outlet opening of, and is of one piece with, the second fan shell section. The two fan shell sections are secured to each other in order to define a chamber between them. A suction fan is located in the chamber for drawing a suction at the suction opening and directing air through the air outlet tube.

20 Claims, 4 Drawing Sheets

COMPACT AIR PATH CONSTRUCTION FOR VACUUM CLEANER

BACKGROUND OF THE INVENTION

The invention relates to vacuum cleaners. More specifically, the present invention relates to small portable lightweight vacuum cleaners adapted to be hand carried.

The invention is particularly adapted for use with an elongated stick type or broom type vacuum cleaner. However, it should be appreciated by those of average skill in the art that the invention could also be utilized on a variety of other vacuum cleaner products.

Elongated stick or broom type vacuum cleaners generally comprise an upstanding dust collecting assembly having a nozzle mounted on the lower end thereof. The nozzle generally comprises a housing which is rotatable in relation to the dust collecting assembly so that the dust collecting assembly can be manipulated relative to the nozzle. In this way, the nozzle can be moved under or around furniture in confined spaces and the like.

The ease of manipulation and maneuverability afforded by stick type vacuum cleaners has resulted in widespread use of such products. However, with conventional stick type vacuum cleaners, certain problems were faced either from the standpoint of efficiency in cleaning or from the standpoint of expense of manufacture. One problem has been that broom type vacuum cleaners are fairly small in size which by itself limits the size of the filter means that can be provided in such vacuum cleaners to trap and hold dirt. The size of the filter means is further limited by the space in the housing required for the air passages to direct the air from a suction stub of the vacuum cleaner to the filter means. In addition, in conventional stick type vacuum cleaners, numerous air path defining elements are required and this increases manufacturing and assembly costs.

Accordingly, it is desirable to develop a new and improved stick type vacuum cleaner which would overcome the foregoing difficulties and others while providing better and more advantageous overall results.

BRIEF SUMMARY OF THE INVENTION

According to the present invention, a new and improved air path for a vacuum cleaner is provided.

More particularly, in accordance with this aspect of the invention, the air path comprises a first fan shell section having a first end, at which is located a suction opening, and a second end and a second fan shell section having a first end and a second end, at which is located an outlet opening. An air outlet tube is located at the outlet opening and is of one piece with the second fan shell section. A means is provided for securing the first fan shell section second end to the second fan shell section first end in order to define a chamber between the first and second fan shells. A suction fan is located in the chamber for drawing a suction at the suction opening and directing air through the air outlet tube.

Preferably, the air path further comprises a suction stub extending away from the first fan shell section and of one piece therewith. The suction opening is located at a free end of the suction stub. The air outlet tube preferably further comprises a mounting wall for mounting a motor which drives the suction fan. Preferably, the means for securing the first and second fan shells together comprises cooperating ears on each shell section and a fastening element securing the cooperating ears together. The outlet opening of the second shell section is preferably located at a radially outer periphery of the second shell section.

In accordance with another aspect of the invention, a portable vacuum cleaner is provided.

More particularly in accordance with this aspect of the invention, the portable vacuum cleaner comprises a housing which is hollow and has first and second ends. A first fan shell section having a first end, at which is located a suction opening, and a second end cooperates with a second fan shell section having a first end and a second end at which is located an outlet opening. An air outlet tube is located at the outlet opening and is of one piece with the second fan shell section. A means is provided for securing the first fan shell second end to the second fan shell first end in order to define a chamber between the first and second fan shell sections. A suction fan is located in the chamber for drawing a suction at the suction opening and directing air through the air outlet tube. A means for mounting the first and second fan shell sections and the air tube in the housing is provided. The first fan shell section is located at the first end of the housing and the air tube extends towards the second end of the housing. A motor is mounted in the housing and is connected to the suction fan for affecting a rotation of same.

Preferably, the first fan shell section comprises a cup shaped member and a suction stub extends away therefrom. The suction opening is located at the free end of the suction stub such that the suction stub extends through the first end of the housing. Preferably, the extension tube comprises a support wall for holding the motor which drives the suction fan. Preferably, the vacuum cleaner further comprises a nozzle and an air outlet pivot assembly in fluid connection with the suction opening. The air outlet pivot assembly comprises a first tubular section pivotally mounted to a top surface of the nozzle and a second tubular section rotatably mounted on the first section wherein the second tubular section can be selectively brought into fluid connection with the suction opening. The nozzle comprises a nozzle housing having a bottom surface and a top surface and a V-shaped suction opening located on the bottom surface of the nozzle housing. Preferably, a plurality of casters are located in indented sections on the bottom surface of the nozzle. The air outlet tube preferably comprises a pair of spaced walls for supporting the suction motor in the housing.

A transversely extending wall of the air outlet tube cooperates with the housing to define a filter chamber and a motor chamber. Preferably, a filter bag is located in the housing filter chamber and is secured to the outlet end of the outlet tube. The means for securing the first and second shell sections to each other preferably comprises a first ear located on the first shell section and a second ear located on the second shell section as well as a fastener for securing the first and second ears together.

One advantage of the present invention is the provision of a new and improved vacuum cleaner.

Another advantage of the present invention is the provision of a stick type vacuum cleaner having a simplified air path.

Still another advantage of the present invention is the provision of a stick type vacuum cleaner having a more compact air path thereby allowing a larger filter bag capacity for the stick type vacuum cleaner.

Yet another advantage of the present invention is the provision of a stick type vacuum cleaner which employs only a pair of fan shell sections. Integral with a first fan shell section is a suction stub. An air outlet tube is of one piece with a second fan shell section. This simplified construction allows for economies of manufacture and assembly for the vacuum cleaner.

A further advantage of the present invention is the provision of a stick type vacuum cleaner having an air tube which is integral with a fan shell section with the air tube comprising at least one motor mounting wall for supporting the suction motor.

A still further advantage of the present invention is the provision of a stick type vacuum cleaner having an air tube which is integral with a motor shell half with the air tube including a transversely extending wall. This wall cooperates with a housing of the vacuum cleaner in order to define a filter chamber and a motor chamber in the housing.

A yet further advantage of the present invention is the provision of a stick type vacuum cleaner having an air path which employs only a pair of fan shell sections. This provides a simplified duct design which is advantageous because it only requires one sealing joint in the air path, that being at the fan housing.

Still other benefits and advantages of the invention will become apparent to those skilled in the art upon a reading an understanding of the following detailed specification.

BRIEF DESCRIPTION OF THE DRAWINGS

The invention may take form in certain components and structures, a preferred embodiment of which will be described in detail in the specification and illustrated in the accompanying drawings wherein.

DETAILED DESCRIPTION OF THE PREFERRED EMBODIMENT

Figure 1:
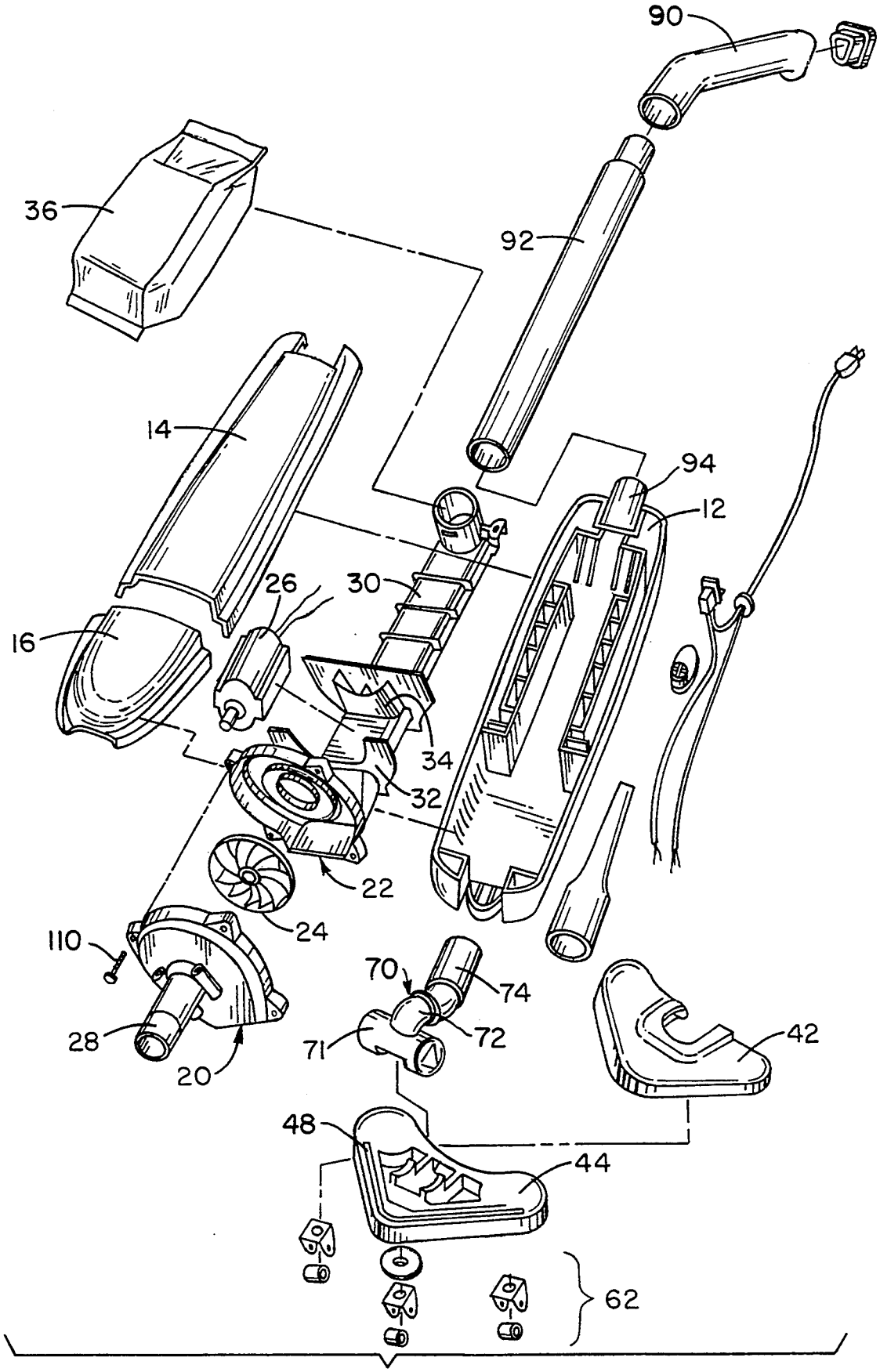
FIG. 1 is an exploded perspective view of the vacuum cleaner according to the present invention.

Referring now to the drawings wherein the showings are for purposes of illustrating a preferred embodiment of the invention only and not for purposes of limiting same, FIG. 1 illustrates a stick type vacuum cleaner or broom type vacuum cleaner. It should be appreciated by those of average skill in the art, however, that the invention disclosed herein could also be applied to various other types of vacuum cleaners.

Figure 2:
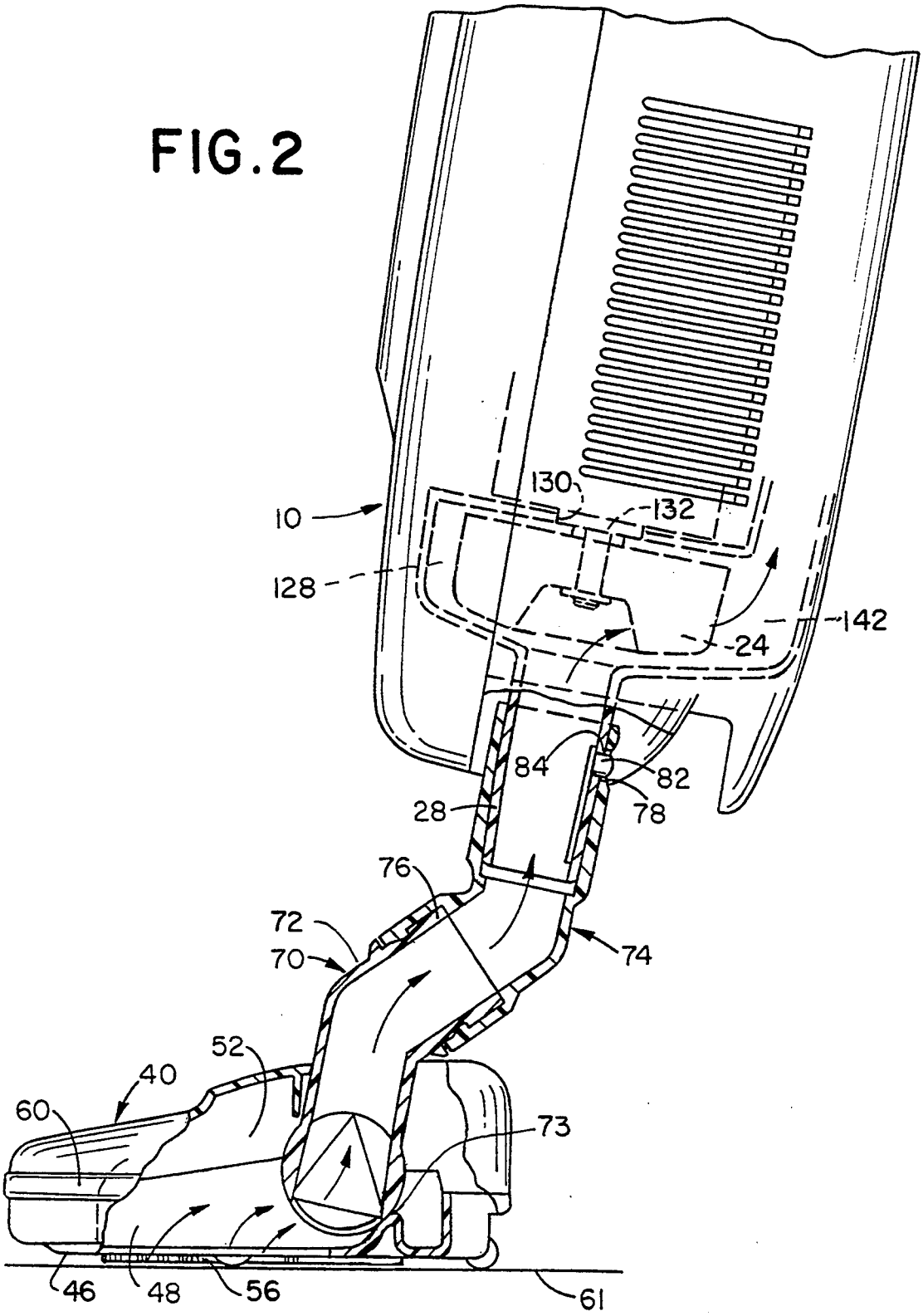
FIG. 2 is an enlarged side elevational view partially in cross section of a lower portion of the vacuum cleaner of FIG. 1 in an assembled condition.

FIG. 2 illustrates that the vacuum cleaner comprises an elongated housing 10. With reference now also to FIG. 1, the housing 10 comprises a back panel housing half 12, a front housing half upper section or panel 14 and a front housing half lower section or motor cover 16. These are all secured together by conventional means.

Also provided is a fan shell first half 20 and a fan shell second half 22 which cooperate to together enclose a suction fan 24 powered by a motor 26. The fan shell first half 20 includes an integral suction stub 28. The fan shell second half 22 includes an integral air tube 30 and a pair of motor mounts 32, 34 for supporting the motor 26. The air tube 30 leads to a filter bag 36 that is positioned within the housing.

FIG. 2 also shows that a nozzle 40 is secured to the lower end of the housing. With reference now again to FIG. 1, the nozzle comprises a cover 42 and a base 44. The nozzle base includes a lower face 46 (FIG. 2) on which is located a V-shaped suction opening 48. As shown in FIG. 2, this opening communicates with a hollow interior 52 of the nozzle housing. Also provided on the lower face 46 is a brush 56 that is located immediately behind the suction opening 48. The brush is useful in order to stir up the dust which is to be vacuumed. An integral bumper 60 encircles the substantially triangular front face of the nozzle 40.

Rotatably supporting the nozzle on a subjacent surface such as the floor surface 61 illustrated in FIG. 2 are a plurality of casters 62. As shown in FIG. 1, preferably three such casters are provided. Such casters can be swiveling or non-swiveling as desired. These are preferably arranged in a substantially triangular or V-shaped arrangement on the lower face 46 of the nozzle 40. Securing each of the casters 62 to the nozzle 40 is a suitable fastener (not illustrated). It is preferred that the casters be located in indented sections formed in the nozzle base lower face 46 so as to bring the suction openings 48 close to a subjacent surface 61 (see FIG. 2) and to reduce the overall height of the nozzle so that it can glide under furniture. Therefore, three such indented sections are preferably provided, one for each of the respective casters.

Communicating with the hollow interior 52 of the nozzle 40 is a pivot assembly comprising a first T-shaped tube section 70 having a barrel 71 and a stem 72. As shown in FIG. 2, the barrel is rotatably mounted in the nozzle 40 by a suitable first mounting means 73. Rotatably secured to the stem 72 of the first tube section 70 is a first end of a second elbow shaped tube section 74 as by second mounting means 76. It is noted that the first and second mounting means 72 and 76 provide the housing 10 with 2 degrees of freedom in relation to the nozzle 40 because the first tube section 70 rotates in relation to the nozzle 40 in the plane of FIG. 2 and the second tube section 74 rotates around the first tube section 70.

Located near a second end of the second tube section 74 in a manner spaced from the second mounting means 76 is an aperture 78 extending through the wall of the tube section. The suction stub 28 extends out of the housing 10 and into the second tube section 74 adjacent the aperture 78. A fastening means comprising a resiliently mounted fastening pin 82 is secured to the suction stub 28. The fastening pin 82 extends through a suitable aperture 84 in the stub and the mating aperture 78 in the second tube section to selectively secure the second tube section 74 and hence the first tube section 70 and the nozzle 40 to the housing 10. It is noted that the first and second tube sections 70, 74 are permanently secured to each other in a rotatable manner and that the first tube section 70 is permanently secured in the nozzle 40 in a rotatable manner.

With reference again to FIG. 1, the vacuum cleaner also includes a first handle 90, that is secured normally to an extender 92 which, in turn, is secured to a handle stub 94 of the housing back half 12.

Figure 3:
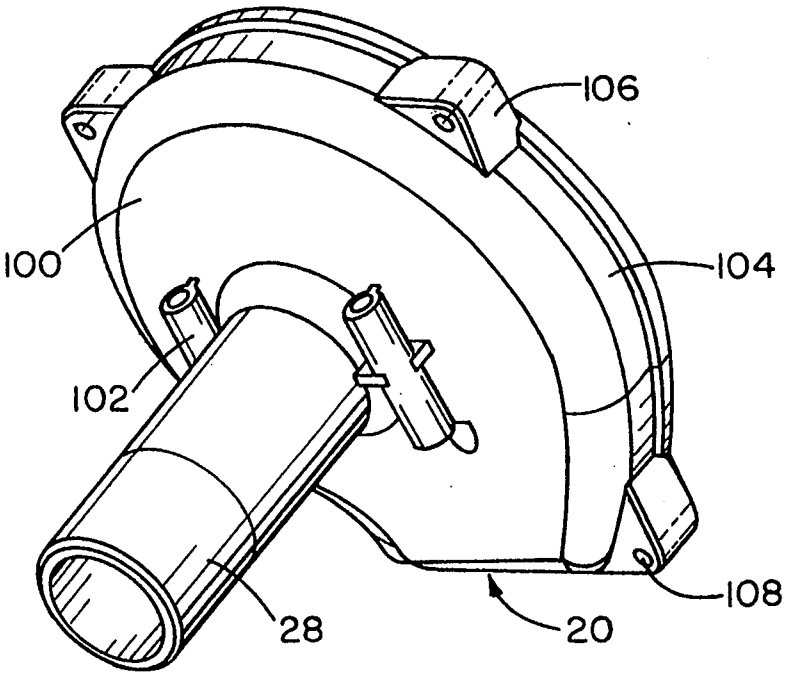
FIG. 3 is an enlarged perspective view of a first fan shell section of the vacuum cleaner of FIG. 1; and, FIG. 4 is an enlarged perspective view of a second fan shell section of the vacuum cleaner of the present invention.

With reference now to FIG. 3, the first fan shell section 20 is somewhat cup-shaped and has an end wall 100 from which the suction stub 28 extends in a transverse manner. Provided on the end wall 100 are a pair of suitable fastener receiving housing elements 102 to which fasteners can be secured for holding the fan shell in the housing 10. Provided on the outer periphery of the end wall 100 is a skirt section 104 which extends away from the suction stub 28. Extending radially outwardly from the skirt 104 are a plurality of ears 106. Each of the ears has a through bore 108 for accommodating a suitable fastener 110 (see FIG. 1).

Figure 4:
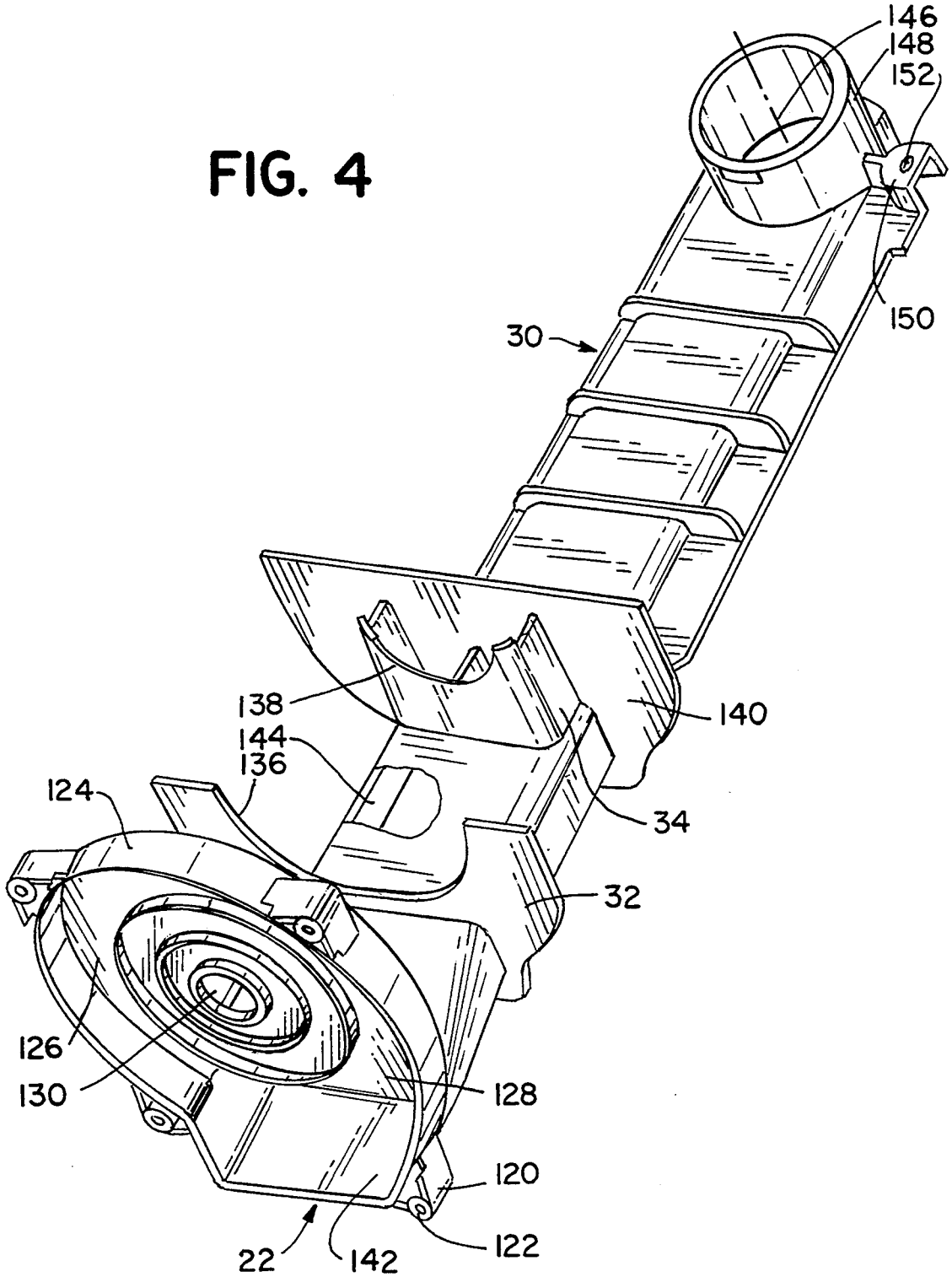

The fasteners serve to secure the first fan shell section 20 to the second fan shell section 22. With reference now to FIG. 4, this is accomplished by way of aligned ears 120 having apertures 122 that are aligned with the apertures 108 on the ears 106 in order to allow the fastener to secure the two fan shell sections together. The ears 120 are located on a skirt 124 extending downwardly from an end wall 126. The end wall 126 of the second fan shell section 22 is parallel to the end wall 100 of the first fan shell section 20. The two end walls 100 and 126 together with the two skirts 104 and 124 cooperate to define a chamber 128 for housing the fan 24. Extending through the second end wall 126 is an aperture 130 for accommodating an end 132 of the motor 26 as can best be seen in FIG. 2 of the drawings.

As mentioned, the motor 26 is supported by a pair of mounting walls 32 and 34 which are located on the air tube 30. To this end, each of the mounting walls includes a suitable cutout 136, 138 sized to support the motor 26. Located adjacent the second mounting wall 34 is a chamber defining end wall 140 which separates the motor chamber of the vacuum cleaner from the filter containing chamber.

The second fan shell section 22 also includes a radially outwardly positioned aperture 142 that leads to a through bore 144 in the air tube 130. The through bore in turn terminates in a transversely oriented opening 146 defined by a collar 148. The collar 148 is adapted to cooperate with the dust bag 36 illustrated in FIG. 1 of the drawings. Located adjacent the collar 148 is an ear 150 having a suitable bore 152 extending therethrough for accommodating a suitable fastener in order to secure the air tube to the back housing section 12.

The provision of a pair of fan shell sections 20 and 22 which, respectively, include the suction stub 28 and the air tube 30 is advantageous from the standpoint that it provides economies of manufacture for the vacuum cleaner. More specifically, the suction stub 28 is of one piece with the first fan shell section 20 and the air tube 30 is of one piece with the second fan shell section 22. Preferably, these components are made from a suitable thermoplastic material which can be, e.g. injection molded into the correct shape for use in the housing 10.

In addition, the provision of an air tube 30 immediately adjacent the second fan shell section at the radially outer periphery thereof makes for a more compact vacuum cleaner suction path leading to the filter bag 36. This enables the provision of a more compact air path system which results in larger bag capacity for the stick type vacuum cleaner. Also, the provision of such an efficient air path allows the use of a smaller motor 26 to power the fan 24 and yet still allows the necessary suction to be drawn at the nozzle 40 of the vacuum cleaner.

Further, the provision of a two piece fan housing, i.e. the fan shell sections 20 and 22 which respectively include an integral suction stub 28 and an integral air tube 30 is advantageous from the standpoint that the air path now requires only one sealing joint. That being at the fan housing. Thus there is likely to be less leakage of air from the air path. A higher level of suction is thus more likely to be drawn by the suction fan 24.

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

We claim:

1. An air path for a vacuum cleaner, comprising:

a first fan shell section having a first end, at which is located a suction opening, and a second end;

a second fan shell section having a first end, and a second end at which is located an outlet opening;

an air outlet tube located at said outlet opening and of one piece with said second fan shell section;

a means for securing said first fan shell second end to said second fan shell first end in order to define a chamber between said first and second fan shell sections; and, a suction fan located in said chamber for drawing a suction at said suction opening and directing air through said air outlet tube, wherein said air outlet tube further comprises a mounting wall extending transversely to a longitudinal axis of said air outlet tube, said mounting wall accommodating an associated motor which drives said suction fan.

2. The air path of claim 1 wherein said outlet opening of said second shell section is located at a radially outer periphery of said second shell section.

3. The air path of claim 1 further comprising a suction stub extending away from said first fan shell section and being of one piece with said first fan shell section, said suction opening being located at a free end of said suction stub.

4. The air path of claim 1 wherein said means for securing said first and second shell sections together comprises cooperating ears located on each of said first and second fan shell sections and a fastener for securing said ears together.

5. A portable vacuum cleaner comprising:

a housing, said housing being hollow and having first and second ends;

a first fan shell section having a first end, at which is located a suction opening, and a second end;

a second fan shell section having a first end, and a second end at which is located an outlet opening;

an air outlet tube located at said outlet opening and of one piece with said second fan shell section;

a means for securing said first fan shell second end to said second fan shell first end in order to define a chamber between said first and second fan shell sections;

a suction fan located in said chamber for drawing a suction at said suction opening and directing air through said air outlet tube;

a means for mounting said first and second fan shell sections and said air tube in said housing, wherein said first fan shell section is located at said first end of said housing and said air tube extends toward said second end of said housing; and, a motor mounted in said housing and connected to said suction fan for effecting a rotation of same.

6. The vacuum cleaner of claim 5 wherein said first fan shell section comprises a cup-shaped member and a suction stub extending away from said cup-shaped member, said suction opening being located at a free end of said suction stub.

7. The vacuum cleaner of claim 5 wherein said air outlet tube comprises a support wall for holding said motor.

8. The vacuum cleaner of claim 5 further comprising:

a nozzle; and, an air outlet pivot assembly in fluid connection with said suction opening, wherein said air outlet pivot assembly comprises:

a first tubular section pivotally mounted to a top surface of said nozzle, and a second tubular section rotatably mounted on said first section, wherein said second tubular section can be selectively brought into fluid connection with said suction opening.

9. The vacuum cleaner of claim 8 wherein said nozzle comprises:

a nozzle housing having a bottom surface and a top surface; and, a V-shaped suction opening located on said bottom surface of said nozzle housing.

10. The vacuum cleaner of claim 9 further comprising a plurality of casters mounted to said nozzle housing and protruding below said bottom surface of said nozzle housing.

11. The vacuum cleaner of claim 5 wherein said outlet tube comprises a wall extending transversely to a longitudinal axis of said outlet tube, said wall cooperating with said housing to define a motor chamber and a filter chamber of the vacuum cleaner.

12. The vacuum cleaner of claim 11 further comprising a filter bag located in said housing filter chamber and secured to an outlet end of said air outlet tube.

13. The vacuum cleaner of claim 5 wherein said air outlet tube comprises a pair of spaced walls having cutouts for accommodating and supporting said suction motor in said housing.

14. The vacuum cleaner of claim 5 wherein said means for securing comprises:

a first ear located on said first shell section;

a second ear located on said second shell section; and, a fastener for securing said first and second ears together.

15. An air path for a vacuum cleaner, comprising:

a fan shell in which is defined a fan chamber;

a suction fan located in said fan chamber;

an air outlet tube through which air is directed by said suction fan wherein said air outlet tube is of one piece with said fan shell;

a motor connected to said suction fan for effecting a rotation of same; and, a mounting wall depending from said air outlet tube and extending transversely to a longitudinal axis of said air outlet tube, said mounting wall providing support for said motor.

16. The air path of claim 15 wherein said fan shell is disposed in a plane and said air outlet tube longitudinal axis extends normal to the plan.

17. The air path of claim 16 wherein said fan shell has a radially outer periphery and said air outlet tube is located at said radially outer periphery.

18. The air path of claim 15 further comprising a suction stub which is of one piece with said fan shell, a suction opening being located at a free end of said suction stub.

19. The air path of claim 15 wherein said air outlet tube comprises an outlet opening which is oriented normal to said air outlet tube longitudinal axis.

20. The air path of claim 19 wherein said air outlet tube further comprises a separation wall extending transversely to a longitudinal axis of said outlet tube, said separation wall being positioned between said mounting wall and said outlet opening.

* * * * *